US007082917B2

(12) United States Patent
Saitoh et al.

(10) Patent No.: US 7,082,917 B2
(45) Date of Patent: Aug. 1, 2006

(54) ENGINE

(75) Inventors: Teruyuki Saitoh, Saitama (JP); Keita Ito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/131,460

(22) Filed: May 18, 2005

(65) Prior Publication Data

US 2005/0257765 A1 Nov. 24, 2005

(30) Foreign Application Priority Data

May 21, 2004 (JP) ..... 2004-152425

(51) Int. Cl.
*F02F 1/42* (2006.01)

(52) U.S. Cl. ..... 123/193.5; 123/90.27; 123/195 C

(58) Field of Classification Search ..... 123/193.5, 123/90.27, 195 C, 572–573
See application file for complete search history.

(56) References Cited

U.S. PATENT DOCUMENTS 4,291,650 A * 9/1981 Formia et al. ..... 123/41.82 A
4,727,833 A * 3/1988 Nakashima ..... 123/195 C
4,972,813 A * 11/1990 Sugiura ..... 123/193.5
5,522,354 A * 6/1996 Sakamoto et al. ..... 123/193.5
5,609,129 A * 3/1997 Hauf et al. ..... 123/193.5
6,279,529 B1 * 8/2001 Komatsu et al. ..... 123/193.5
6,484,679 B1 * 11/2002 Ito et al. ..... 123/90.31
6,953,015 B1 * 10/2005 Asari et al. ..... 123/90.27

FOREIGN PATENT DOCUMENTS

JP 2-32849 9/1990

* cited by examiner

*Primary Examiner*—Marguerite McMahon
(74) *Attorney, Agent, or Firm*—Arent Fox PLLC

(57) ABSTRACT

An engine includes a cylinder head having a valve-operating chamber. A cylinder head is coupled to a cylinder block by a plurality of fastening bolts. A head cover is coupled to the cylinder head to close the valve-operating chamber. A ventilating gap is defined between a face of the cylinder head fastened by the fastening bolts and a bottom wall of the valve-operating chamber. An operating bore is provided in the bottom wall to enable insertion of at least one of the fastening bolts and a tool for tightening the fastening bolt. A plug is integrally provided in the head cover to be liquid-tightly fitted into the operating bore. Cooling of portions around the bottom wall of the valve-operating chamber is improved, while the cylinder head can be fastened to the cylinder block from the side of the valve-operating chamber by the fastening bolts.

4 Claims, 11 Drawing Sheets

ENGINE

RELATED APPLICATION DATA

The present invention is based upon Japanese priority application No. 2004-152425, which is hereby incorporated in its entirety herein by reference.

BACKGROUND OF THE INVENTION

1. Field of the Invention

The present invention relates to an improvement in an engine including a cylinder head having a valve-operating chamber with an open upper surface. The cylinder head is coupled to a cylinder block by a plurality of fastening bolts. A head cover is coupled to the cylinder head to close the valve-operating chamber.

2. Description of the Related Art

Such a conventional engine is disclosed, for example, in Japanese Utility Model Publication No. 2-32849.

In the conventional engine, in coupling a cylinder head to a cylinder block by a plurality of fastening bolts, one or more of the fastening bolts is, or are, disposed in a valve-operating chamber in the cylinder head. A bottom wall of the valve-operating chamber is fastened to the cylinder head. In such an arrangement, the bottom wall of the valve-operating chamber is brought into close contact with the cylinder block to affect the cooling of portions around the bottom wall of the valve-operating chamber, as well as portions around the combustion chamber.

SUMMARY OF THE INVENTION

Accordingly, it is an aspect of the present invention to provide an engine, wherein cooling of portions around a valve-operating chamber is improved, while enabling coupling of a cylinder head to a cylinder block from the side of the valve-operating chamber by fastening bolts.

To achieve the above, and other aspects, according to the present invention, there is provided an engine including a cylinder head having a valve-operating chamber with an open upper surface. A cylinder head is coupled to a cylinder block by a plurality of fastening bolts. A head cover is coupled to the cylinder head to close the valve-operating chamber. A ventilating gap is defined between a face of the cylinder head fastened by the fastening bolts and a bottom wall of the valve-operating chamber. An operating bore is provided in the bottom wall to enable insertion of at least one of the fastening bolts therein and a tool for tightening the fastening bolt. A plug integrally provided in the head cover is liquid-tightly fitted into the operating bore.

With the present invention, the ventilating gap is defined between the face of the cylinder head fastened by the fastening bolts and the bottom wall of the valve-operating chamber. Therefore, by passing cooling air through the ventilating gap, portions around the bottom wall of the valve-operating chamber and portions around the combustion chamber in the cylinder head are effectively cooled. Further, heat transfer from the combustion chamber to the valve-operating chamber is suppressed, which enhances the durability of a valve-operating mechanism in the valve-operating chamber.

Furthermore, the fastening bolt is operated by a tool, such as, for example only, a wrench, from the side of the valve-operating chamber through the operating bore provided in the bottom wall of the valve-operating chamber. As such, the cylinder head is firmly fastened to the cylinder block.

When the cylinder head is coupled to the head cover to close the valve-operating chamber after the cylinder head has been fastened to the cylinder block, the plug integral with the head cover is liquid-tightly fitted into the operating bore. Accordingly, the valve-operating chamber and the operating bore are isolated from each other to simply and reliably prevent oil from flowing out of the valve-operating chamber into the operating bore.

BRIEF DESCRIPTION OF THE DRAWINGS

The above, and other aspects, features and advantages of the present invention will become apparent from the following description of the preferred embodiment taken in conjunction with the accompanying drawings.

DETAILED DESCRIPTION OF THE PREFERRED EMBODIMENT

The present invention will now be described by way of an embodiment with reference to the accompanying drawings.

Figure 1:
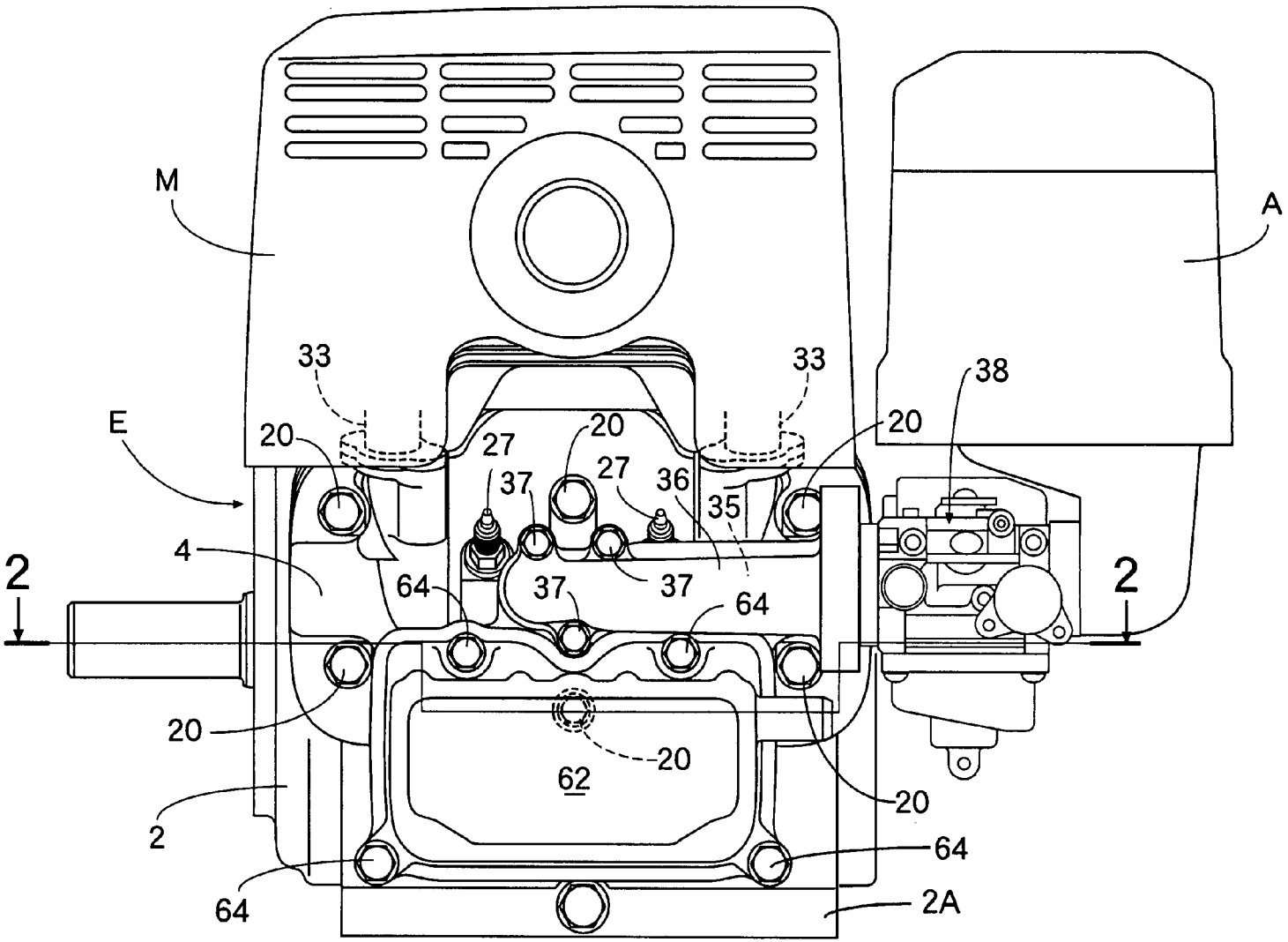
FIG. 1 is a front view of a multi-cylinder engine according to a preferred embodiment of the present invention.
Figure 2:
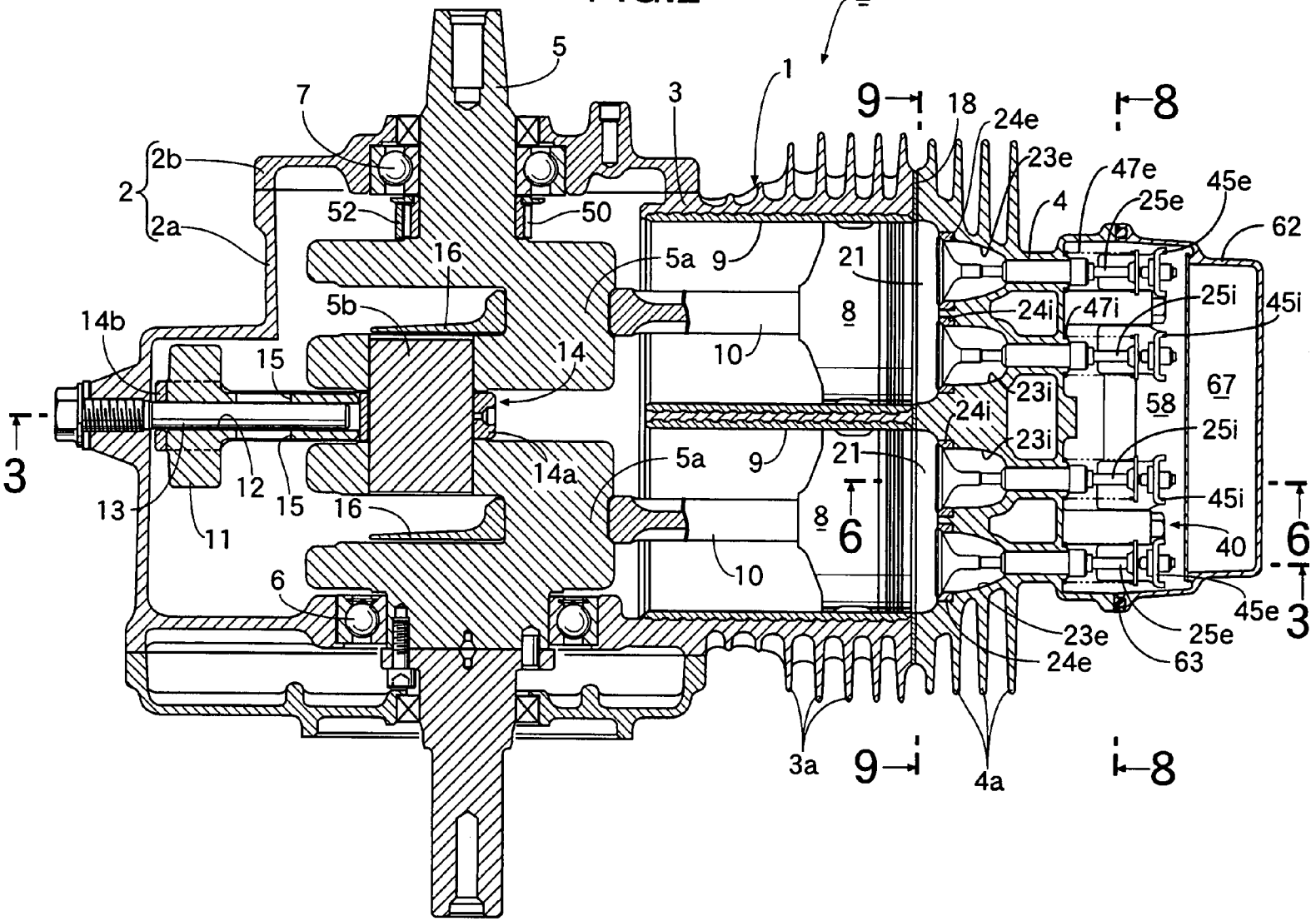
FIG. 2 is a cross-sectional view taken along line 2—2 in FIG. 1.
Figure 3:
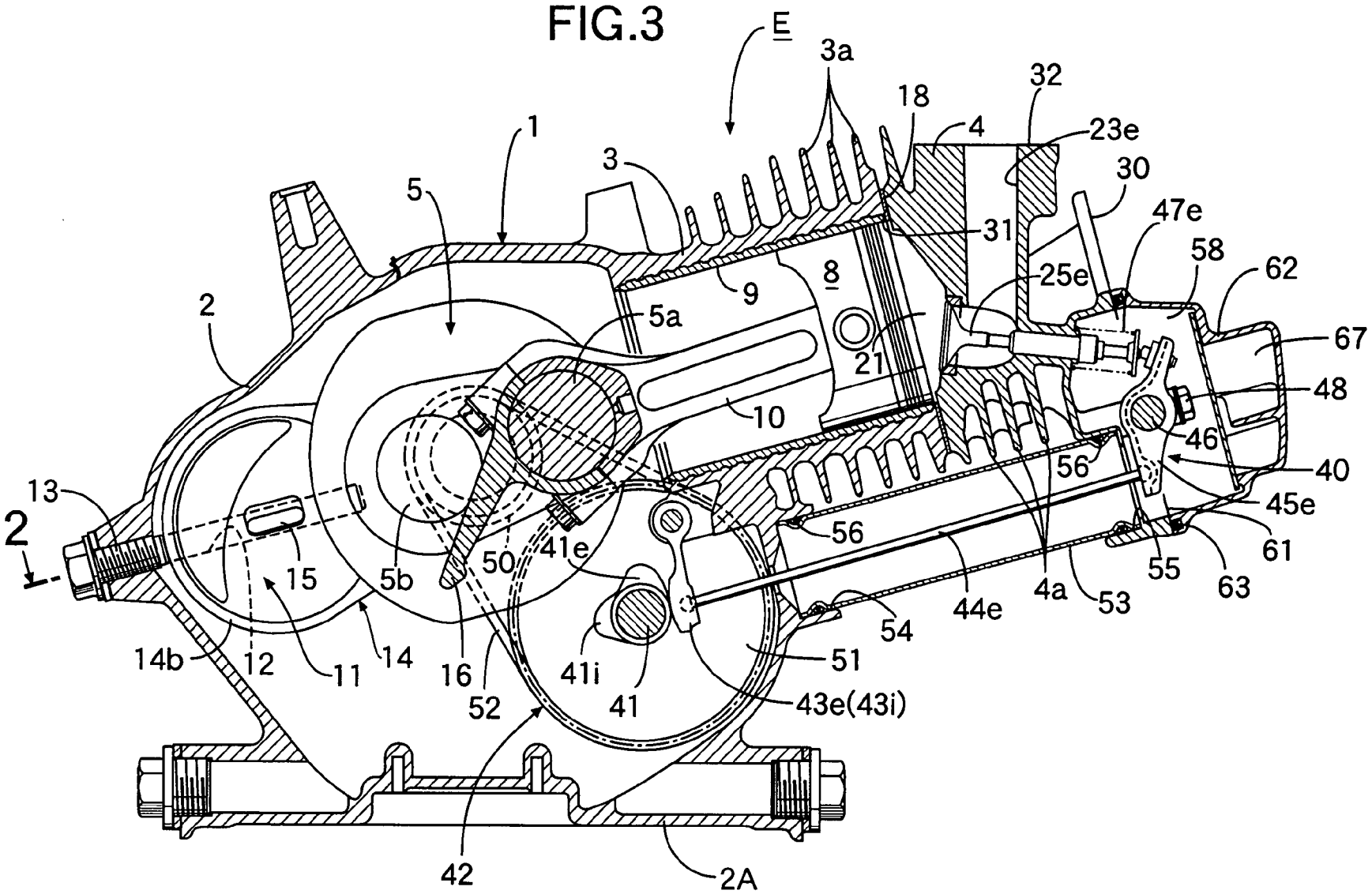
FIG. 3 is a cross-sectional view taken along line 3—3 in FIG. 2.

Referring first to FIGS. 1 to 3, an exemplary engine E depicted therein is a water-cooling, in-line, two-cylinder, general-purpose engine. The engine E, which horizontally carries a crankshaft 5, includes an engine body 1 having a crankcase 2 with a mounting flange 2A on a lower surface. A cylinder block 3 protrudes obliquely upward on one side from the crankshaft 2. A cylinder head 4 is coupled to an upper end face of the cylinder block 3 with a gasket 18 interposed therebetween. A plurality of heat-dissipating fins 3*a*, 4*a* are projectingly provided on outer peripheral surfaces of the cylinder block 3 and the cylinder head 4. An exhaust muffler M is disposed above the cylinder head 4, and an air cleaner A is disposed on one side of the exhaust muffler M.

The crankcase 2 includes a case body 2*a* integrally molded with the mounting flange 2A and the cylinder block 3 and which has one side face opened. A bearing bracket 2*b* is bolted to the opened side face of the case body 2*a*. The crankshaft 5 is supported at opposite ends by sidewalls of the case body 2*a* and the bearing bracket 2*b* with ball bearings 6 and 7 interposed between the opposite ends of the crankshaft 5 and the sidewalls. The crankshaft 5 includes a pair of left and right crankpins 5*a*, 5*a* of the same phase and an auxiliary crankpin 5*b* disposed between the crankpins 5*a*, 5*a* in a phase opposite the crankpins 5*a*, 5*a*. A pair of cylinders 9, 9 is formed in the cylinder block 3. The cylinders 9, 9 are arranged laterally in parallel to each other in correspondence to the crankpins 5*a*, 5*a*. The ignition timings in the cylinders 9, 9 are set to be offset from each other by a crank angle of 360°.

The crankpins 5*a*, 5*a* are connected to a pair of pistons 8, 8 slidably received in the cylinders 9, 9 through a pair of connecting rods 10, 10, respectively.

Figure 4:
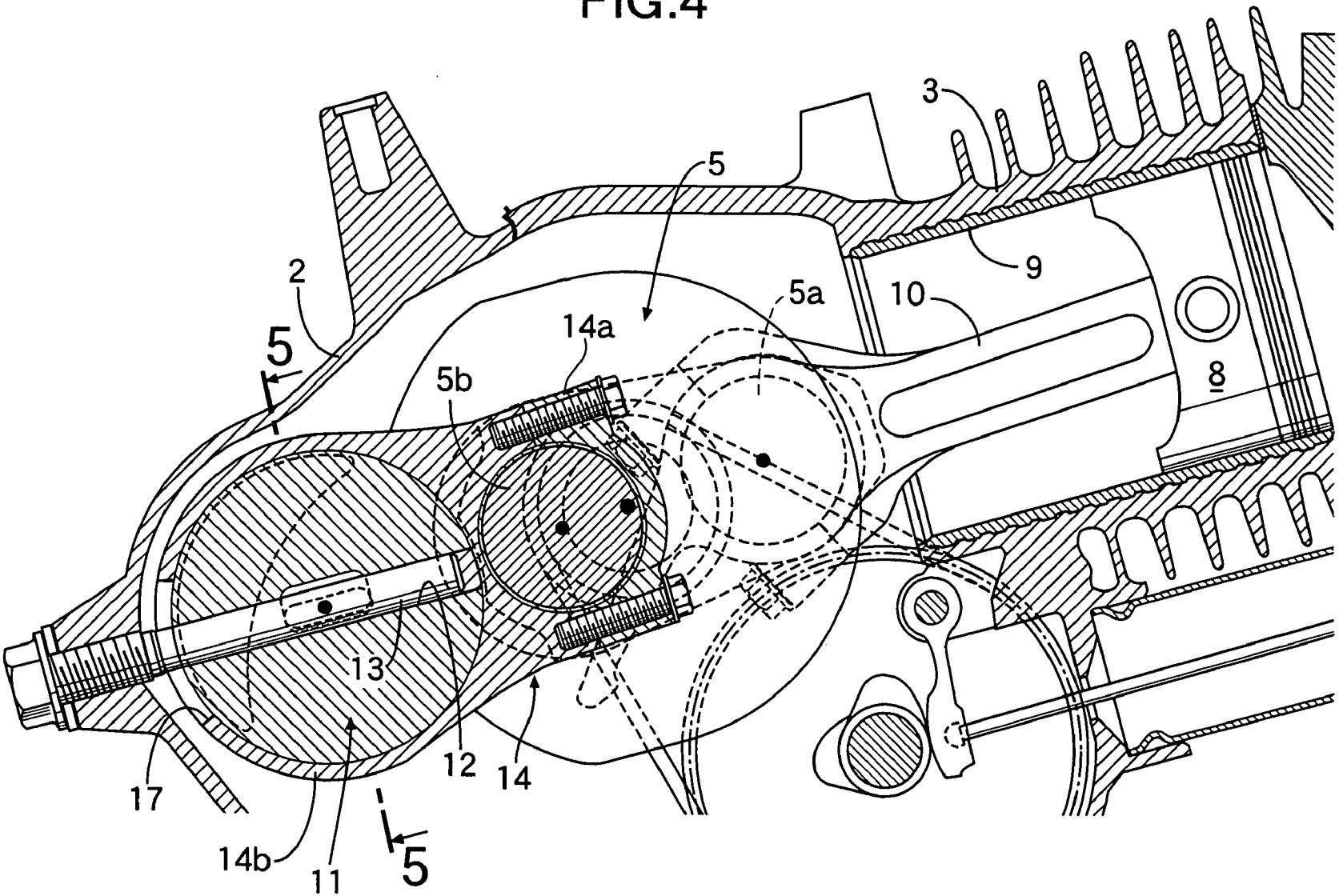
FIG. 4 is an enlarged sectional view of essential portions of FIG. 3.
Figure 5:
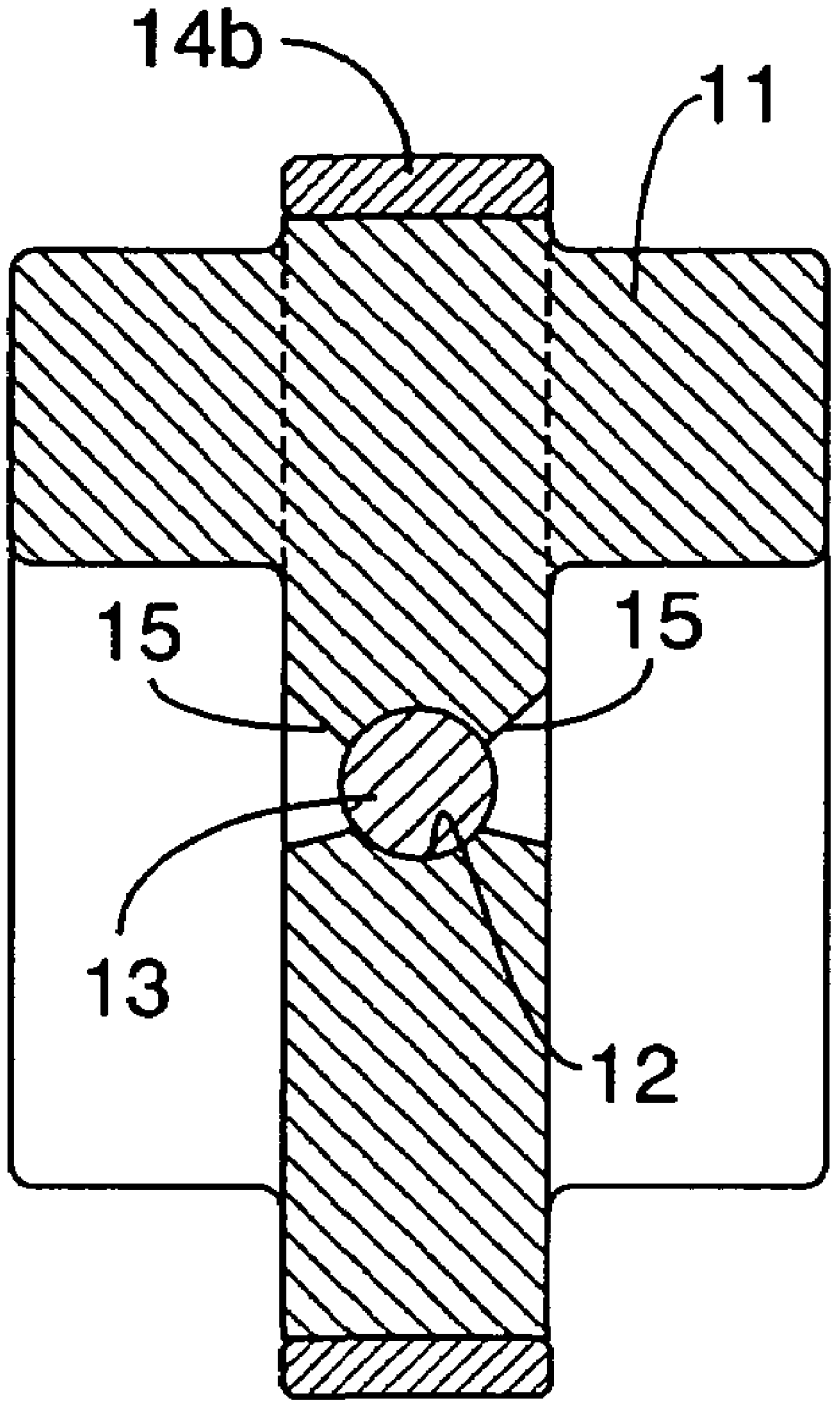
FIG. 5 is a cross-sectional view taken along line 5—5 in FIG. 4.
Figure 6:
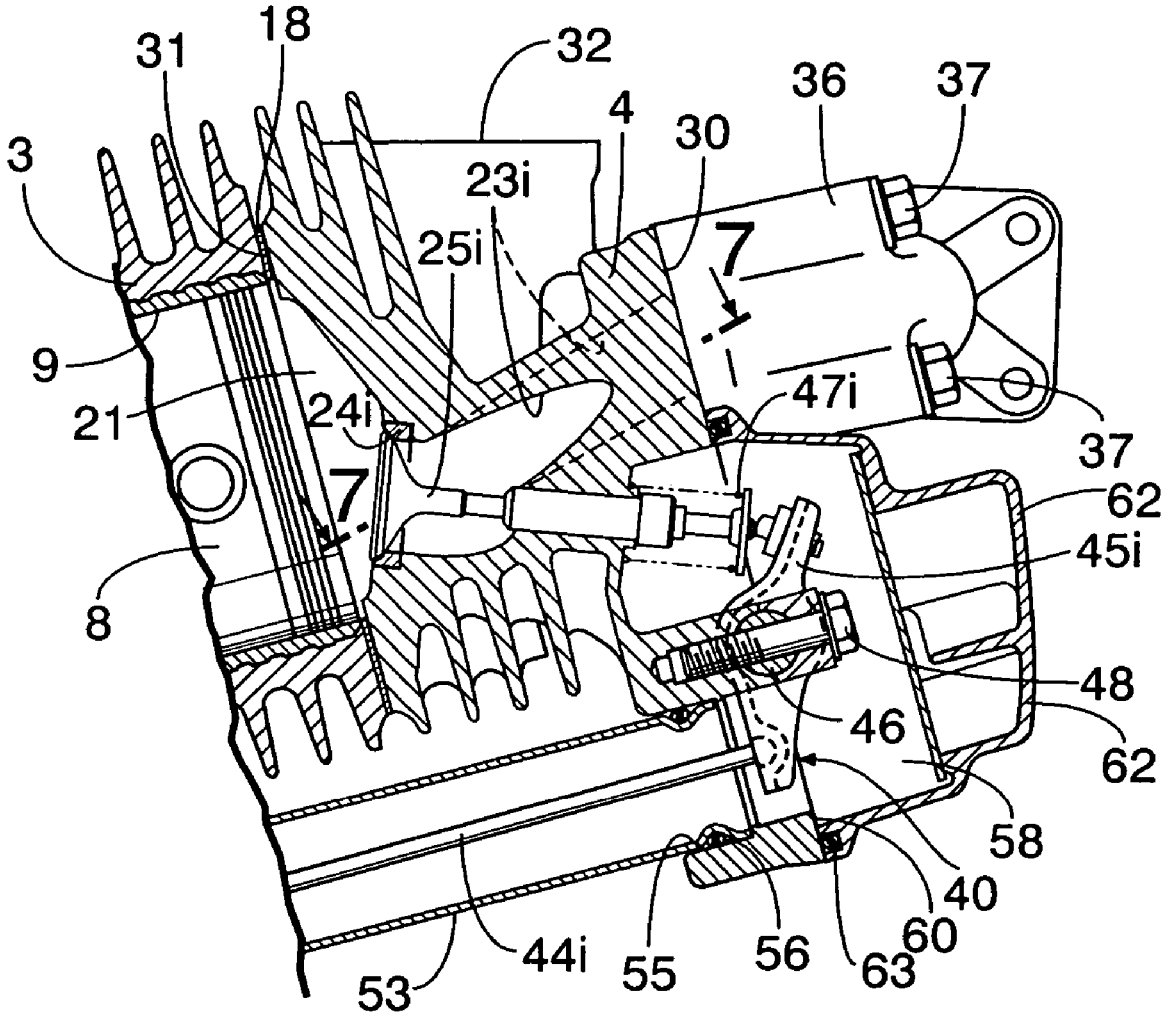
FIG. 6 is a cross-sectional view taken along line 6—6 in FIG. 2.
Figure 7:
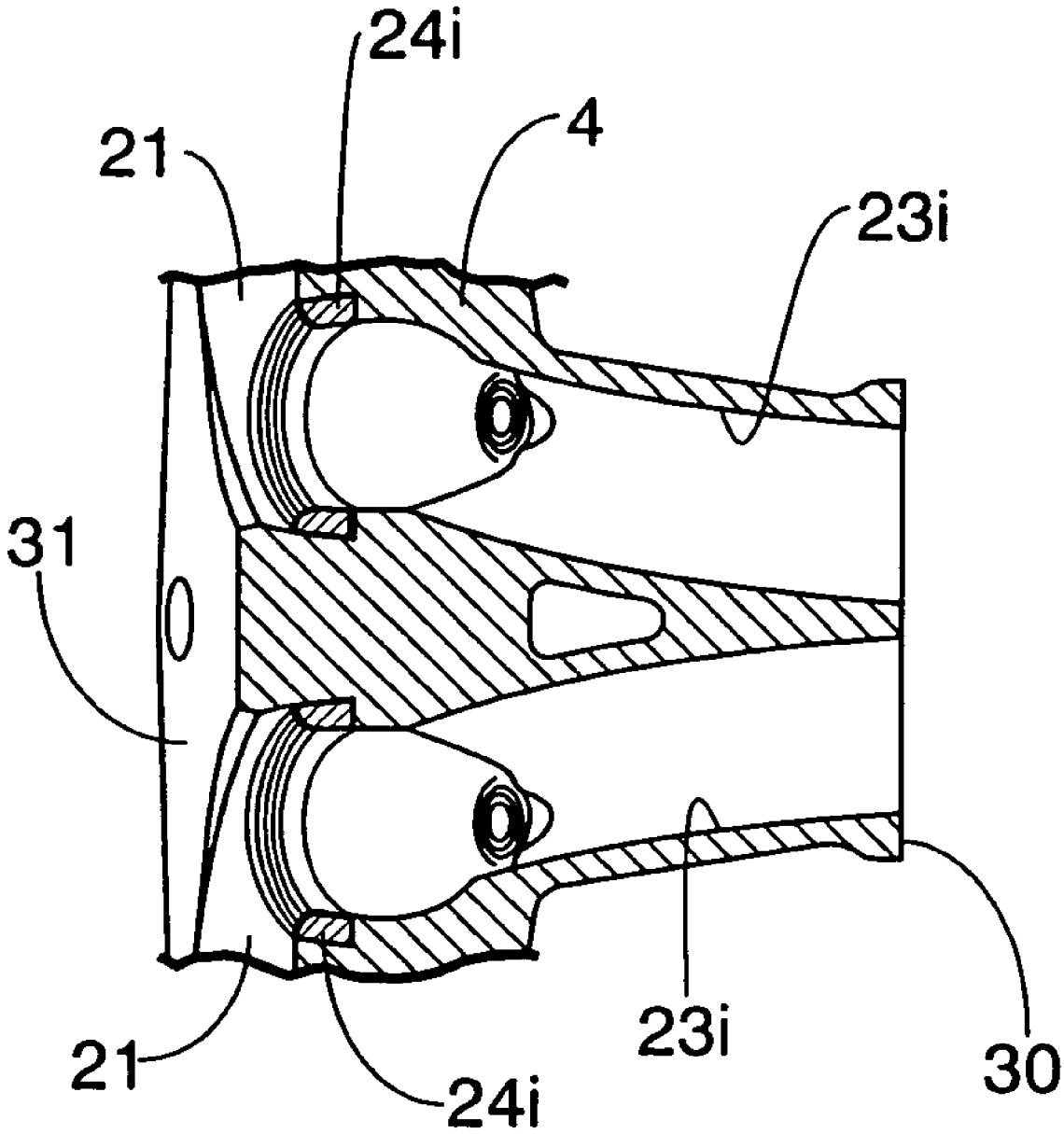
FIG. 7 is a cross-sectional view taken along line 7—7 in FIG. 6.

As shown in FIGS. 2 to 4, a balance weight 11, disposed in the crankcase 2, is reciprocally movable to exhibit an inertia force which balances with an inertia force of each reciprocating part, such as the pistons 8, 8. The balance weight 11 has a disk shape with a guide bore 12 extending through the balance weight 11 along a diametrical line. A guide shaft 13 is relatively slidably received in the guide bore 12 and threadedly fitted into a peripheral wall of the crankcase 2. The balance weight 11 is connected to the auxiliary crankpin 5*b* through an auxiliary connecting rod 14. More specifically, a smaller-diameter annular portion 14*a*, formed at one end of the auxiliary crankpin 5*b*, is relatively rotatably fitted over an outer periphery of the auxiliary crankpin 5*b*, and a larger-diameter annular portion 14*b*, formed at the other end of the auxiliary crankpin 5*b*, is relatively rotatably fitted over an outer periphery of the disk-shaped balance weight 11. The larger-diameter annular portion 14*b* is provided with a long bore 17 through which the guide shaft 13 passes, wherein the rocking of the auxiliary connecting rod 14 around the balance weight 11 is not interfered with by the guide shaft 13.

An oil dipper 16 is formed at a larger end of each connecting rod 10 and is adapted to scatter or otherwise distribute a lubricating oil stored in a bottom of the crankcase 2 during rotation of the crankshaft 5, thereby lubricating various portions within the crankcase 2. Oil bores 15, provided in opposite sidewalls of the balance weight 11, are adapted to introduce the scattered oil into the guide bore 12 of the balance weight 11.

When the pistons 8, 8 are reciprocally moved within the cylinders 9, 9, the reciprocal movement of the pistons 8, 8 is converted into a rotating movement through the connecting rods 10, 10 and the crankpins 5*a*, 5*a*. The rotating movement is then transmitted to the crankshaft 5 from which the rotating movement is output as a rotating power. The rotating movement of the crankshaft 5 is converted again into a reciprocal movement through the auxiliary connecting rod 14 and the auxiliary crankpin 5*b*. The reciprocal movement is then transmitted to the balance weight 11, wherein the balance weight 11 is reciprocally moved along the guide shaft 13.

In this process, the crankpins 5*a*, 5*a* and the auxiliary crankpin 5*b* are in an opposite-phase relationship. In other words, there is a difference in phase of 180° between the crankpins 5*a*, 5*a* and crankpin 5*b*, and hence, the direction of the reciprocal movement of the pistons 8, 8 and the direction of the reciprocal movement of the balance weight 11 are absolutely opposite each other. Therefore, by balancing the inertia force of the reciprocating parts, such as the pistons 8, 8, in axial directions of the cylinders 9, 9 with the inertia force of the balance weight 11 in an axial direction of the guide shaft 13, the primary vibration of the engine E generated with the reciprocal movement of the pistons 8, 8 is eliminated.

As shown in FIGS. 2, 3, 8, 9 and 11, the periphery of the cylinder head 4 is fastened to the cylinder block 3 by a plurality of, e.g., six (in the illustrated embodiment) fastening bolts 20. Pent-roof type combustion chambers 21, 21 are formed in the cylinder head 4 in correspondence to the cylinders 9, 9. Each of the combustion chambers 21, 21 has an intake port 23*i* and an exhaust port 23*e*, which open into one of the inclined surfaces of a ceiling of the combustion chamber 21 (see FIGS. 3 and 9). Valve seat members 24*i*, 24*i* and 24*e*, 24*e* are embedded in the ends of the intake ports 23*i*, 23*i* and the exhaust ports 23*e*, 23*e*, which open into the combustion chambers 21, 21. Intake valves 25*i*, 25*i* and exhaust valves 25*e*, 25*e* are mounted in the cylinder head 4, and are adapted to open and close the intake ports 23*i*, 23*i* and the exhaust ports 23*e*, 23*e* by cooperating with the valve seat members 24*i*, 24*i* and 24*e*, 24*e*. All of the intake and exhaust valves 25*i*, 25*i* and 25*e*, 25*e* are arranged in parallel to each other and in one row in a direction of arrangement of the cylinders 9, 9, with the intake valves 25*i*, 25*i* being disposed inside the exhaust valves 25*e*, 25*e* (see FIGS. 2 and 9). Two spark plugs 27, 27 are threadedly fitted into the cylinder head 4 with their electrodes facing central portions of the ceiling surfaces of the combustion chambers 21, 21.

Referring to FIGS. 1, 3, 6 to 8 and 11, an intake manifold coupling face 30 is formed on the cylinder head 4 in parallel to a face 31 of the cylinder head 4 coupled to the cylinder block 3, and upstream ends of the two intake ports 23*i*, 23*i*, which are adjacent each other, open into the intake manifold coupling face 30. The intake ports 23*i*, 23*i* are disposed so that they are nearing each other toward their upstream ends (see FIG. 7).

The two exhaust ports 23*e*, 23*e* on opposite sides of the intake ports 23*i*, 23*i* are disposed to open into an exhaust pipe coupling face 32 (see FIGS. 3, 6 and 8) of the cylinder head 4 and form a substantially right angle with the intake manifold coupling face 30.

Figure 11:
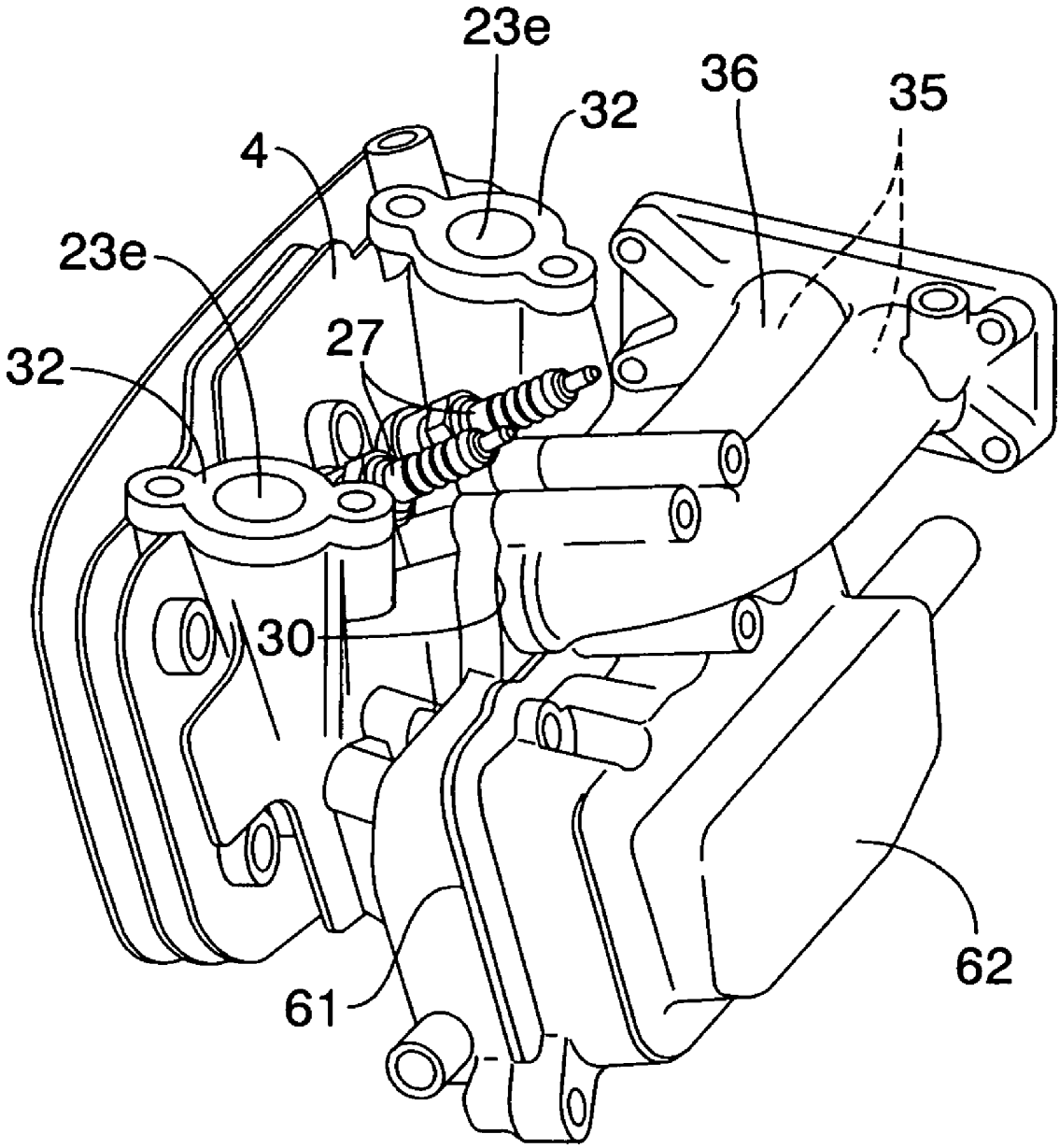
FIG. 11 is a perspective view of a cylinder head and a section around the cylinder head.

An intake manifold 36, having a pair of intake passages 35, 35 communicating with the two intake ports 23*i*, 23*i*, is coupled to the intake manifold coupling face 30 by a plurality of bolts 37. The pair of intake passages 35, 35 extends to rise from the intake manifold coupling face 30 and is then bent at a substantially right angle to extend across an outer side of one of the exhaust ports 23 and one side of one of the spark plugs 27, as shown in FIGS. 1 and 11. A twin carburetor 38 that supplies an air-fuel mixture individually to each intake passage 35 is connected to the intake manifold 36. The air cleaner A is connected to an intake path inlet of the twin carburetor 38.

Exhaust pipes 33, 33 (see FIG. 1) are mounted to the exhaust pipe coupling face 32 to permit communication of the exhaust ports 23*e*, 23*e* with the exhaust muffler M.

A valve operating mechanism 40 that opens and closes the intake valves 25*i*, 25*i* and the exhaust valves 25*e*, 25*e* will be described below with reference to FIGS. 2, 3, 6 and 10 and particularly to FIG. 4. The valve operating mechanism 40 includes a camshaft 41 carried in the crankcase 2 and disposed in parallel to and below the crankshaft 5. A timing transmitting device 42 transmits rotation of the crankshaft 5 to the camshaft 41 at a predetermined timing. Intake cam followers 43*i*, 43*i* and exhaust cam followers 43*e*, 43*e* are carried in the cylinder block 3 and contact an intake cam 41*i* and an exhaust cam 41*e*, respectively, provided on the camshaft 41 in correspondence to the intake valves 25*i*, 25*i* and the exhaust valves 25*e*, 25*e*, so that the intake cam followers and exhaust cam followers are swung. Intake rocker arms 45*i*, 45*i* and exhaust rocker arms 45*e*, 45*e* are swingably supported in the cylinder head 4 through a common rocker shaft 46 with their one ends abutting against heads of the intake valves 25*i*, 25*i* and the exhaust valves

25*e*, 25*e*. Intake pushrods 44*i*, 44*i* and exhaust pushrods 44*e*, 44*e* link the intake cam followers 43*i*, 43*i* and the exhaust cam followers 43*e*, 43*e* to the other ends of the intake rocker arms 45*i*, 45*i* and the exhaust rocker arms 45*e*, 45*e*. Intake valve springs 47*i*, 47*i* and exhaust valve springs 47*e*, 47*e* bias the intake valves 25*i*, 25*i* and the exhaust valves 25*e*, 25*e* in closing directions, respectively. The rocker arm 46 is secured to the cylinder head 4 by a bolt 48 (see FIG. 6).

The timing transmitting device 42 is constructed by reeving a cog belt 52 around a toothed drive pulley 50 secured to the crankshaft 5 and a follower pulley 51 secured to the camshaft 41. The timing transmitting device 42 is adapted to transmit the rotation of the crankshaft 5 to the camshaft 41 while reducing the rotational speed to one-half.

Intermediate portions of the intake pushrods 44*i*, 44*i* and the exhaust pushrods 44*e*, 44*e* are disposed outside the cylinder block 3 and the cylinder head 4. For each of the cylinders 9, 9, two cylindrical pushrod-accommodating tubes 53, 53, covering the intermediate portions of the intake pushrods 44*i*, 44*i* and the exhaust pushrods 44*e*, 44*e*, are fitted at their opposite ends into mounting bores 54 and 55 in the cylinder block 3 and the cylinder head 4 via seal members 56, 56, respectively. By employing such pushrod-accommodating tubes 53, 53, it is not necessary to provide accommodating chambers exclusive for the pushrods, and thus, it is possible to reduce the size of the cylinder block 3 and the size of the cylinder head 4, wherein the size and weight of the engine E is significantly reduced.

Figure 8:
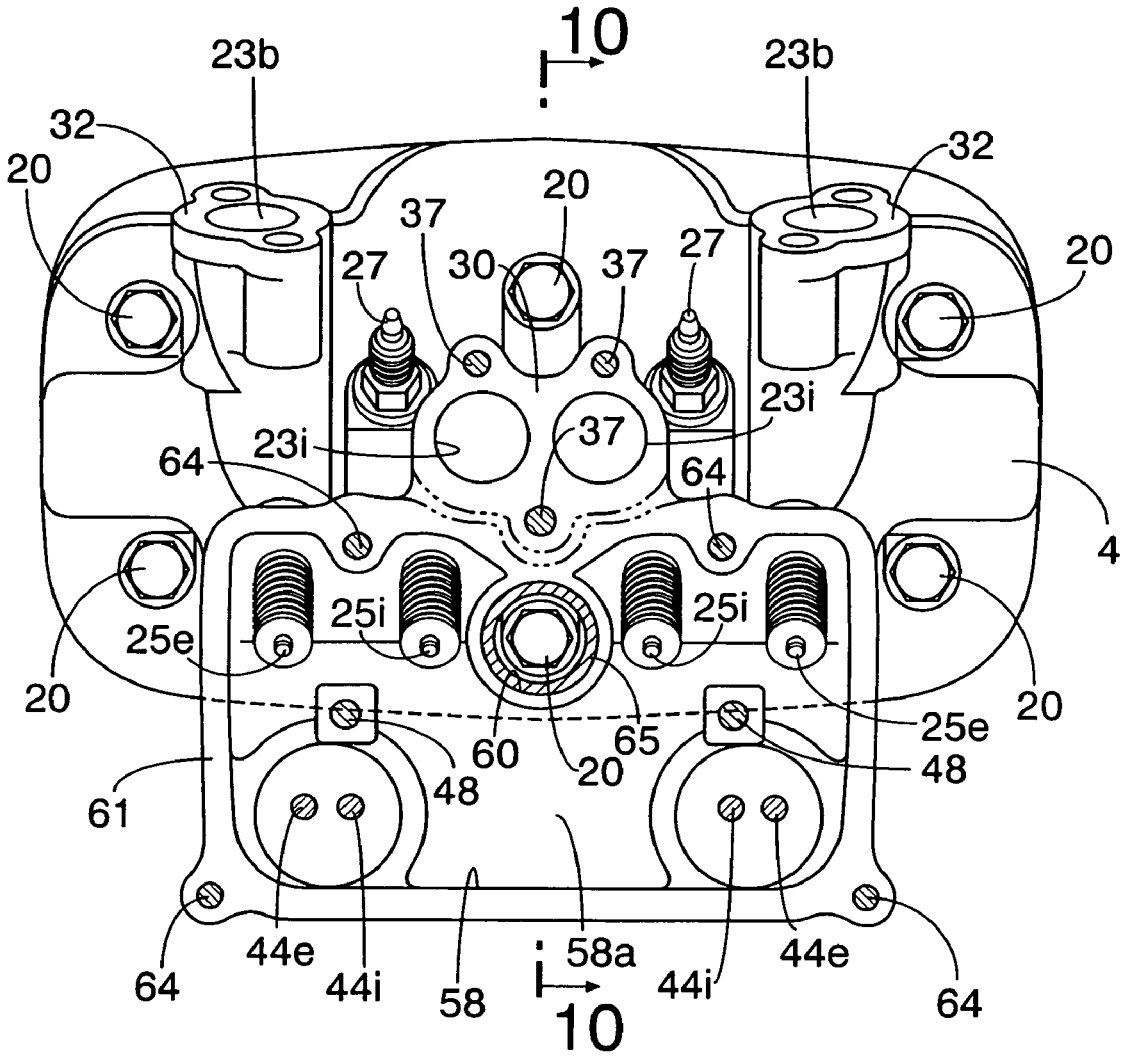
FIG. 8 is a cross-sectional view taken along line 8—8 in FIG. 2.
Figure 9:
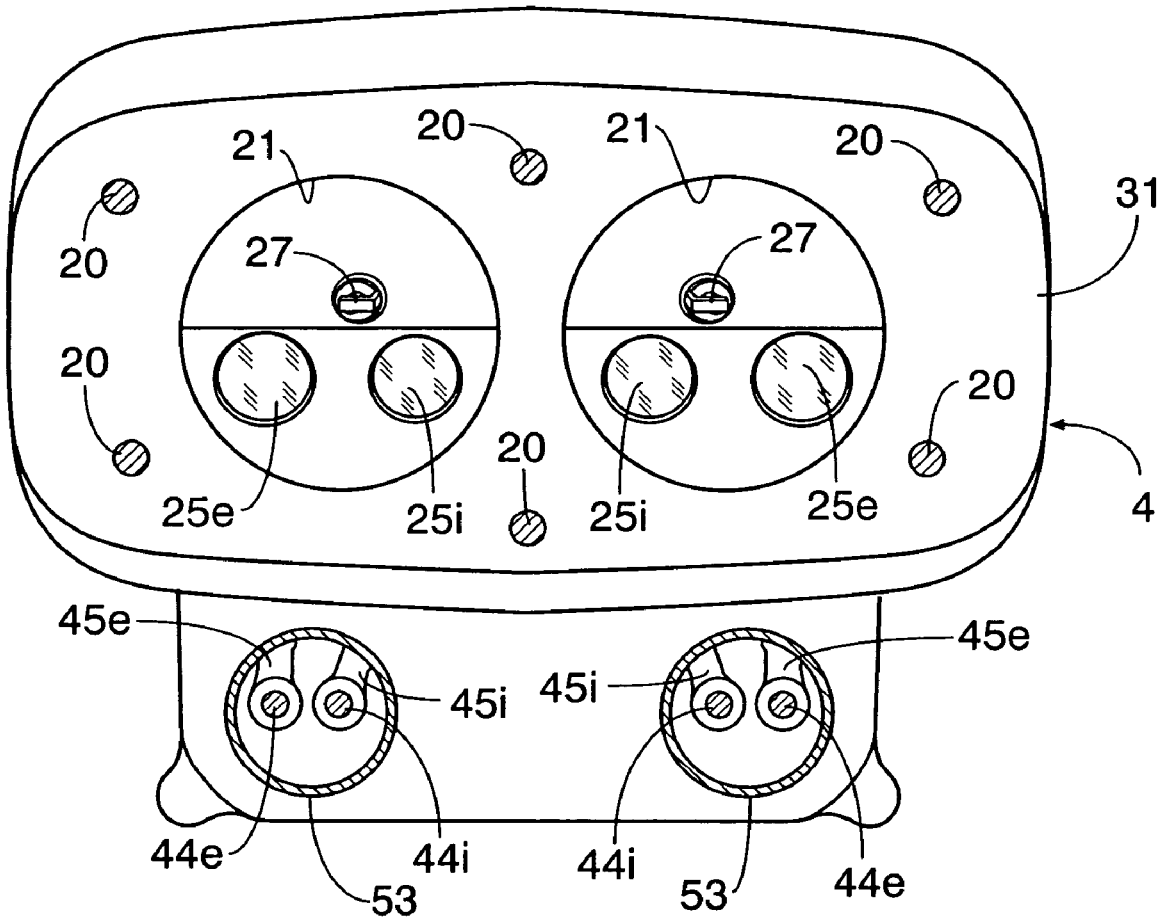
FIG. 9 is a cross-sectional view taken along line 9—9 in FIG. 2.
Figure 10:
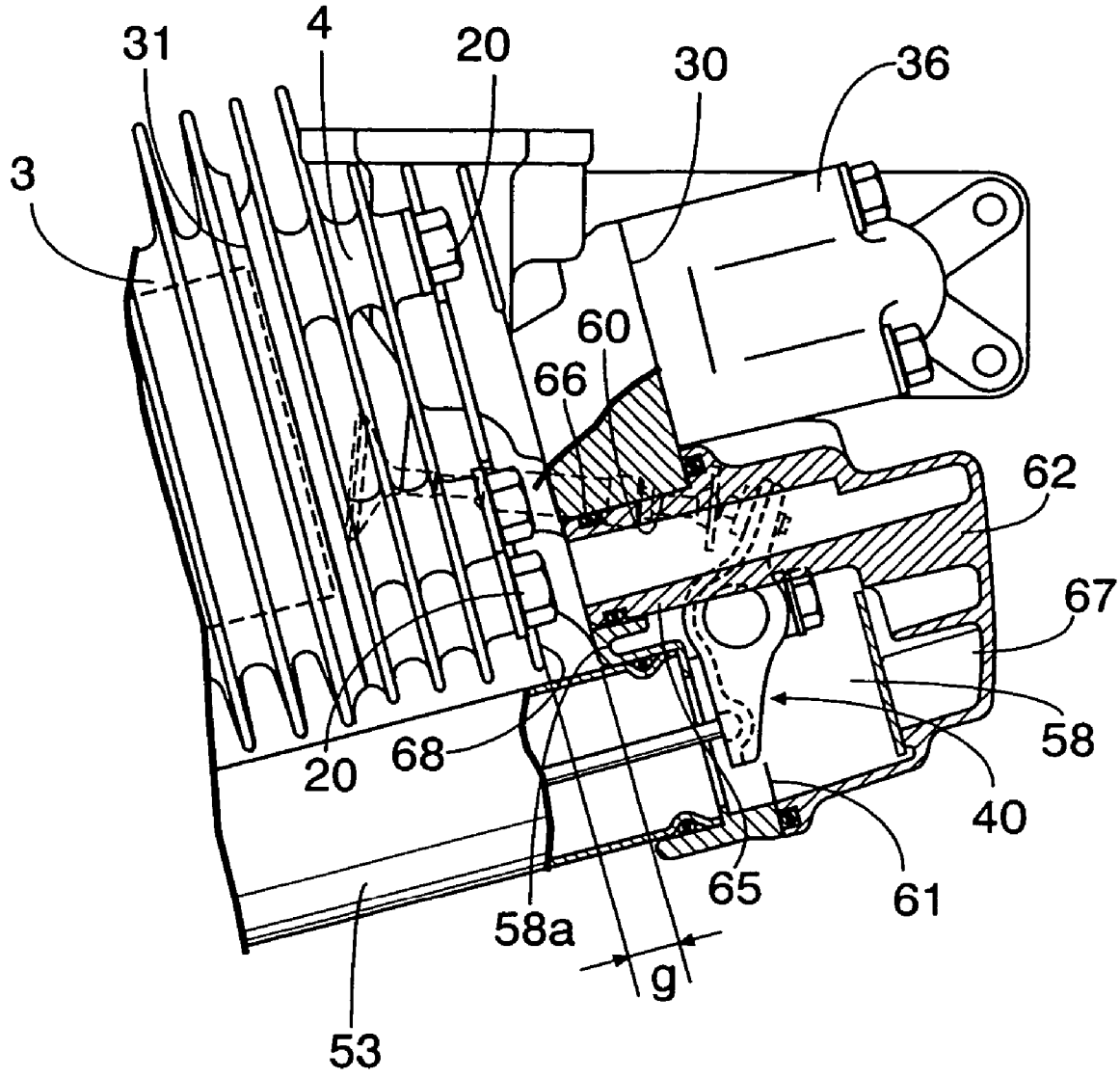
FIG. 10 is a cross-sectional view taken along line 10—10 in FIG. 8.

As shown in FIGS. 2, 3, 8 and 10, a valve-operating chamber 58, which accommodates the valve-operating mechanism 40 including the intake rocker arms 45*i*, 45*i* and the exhaust rocker arms 45*e*, 45*e*, is formed in the cylinder head 4 to protrude to one side to cover a head or heads of one or more of the plurality of fastening bolts 20 (in FIG. 8, central one of the three fastening bolts 20 arranged on one side of the cylinders 9, 9). In this case, a ventilating gap g (see FIG. 10) is provided between a bottom wall 58*a* of the valve-operating chamber 58 and a face 68 of the cylinder head 4 fastened by the fastening bolts 20. An operating bore 60 is provided in the bottom wall 58*a* to permit the insertion of the central fastening bolt 20 and a box wrench is provided for tightening the bolt 20. Therefore, even in an arrangement in which the head of the central fastening bolt 20 is covered with the valve-operating chamber 58, tightening of the fastening bolt 20 is conducted through the operating bore 60.

A head cover coupling face 61 is formed to be flush with, and connected to, the intake manifold coupling face 30. The valve-operating chamber 58 opens into the head cover coupling face 61. A head cover 62 for closing the valve-operating chamber 58 is coupled to the head cover coupling face 61 by a plurality of bolts 64 with a seal member 63 interposed therebetween. The head cover 62 is integrally formed with a cylindrical plug 65 which is fitted into the operating bore 60 with a seal member 66 interposed therebetween. As a result, the operating bore 60 and the valve-operating chamber 58 are liquid-tightly isolated from each other.

Because the head cover coupling face 61 and the intake manifold coupling face 30 are formed flush with, and connected to, each other as described above, both the coupled faces 30 and 61 can be finished at a stroke in the cylinder head 4 by the same cutting tool, leading to good processability, an increase in processing accuracy, and a reduction in cost.

The head cover 62 is provided with a labyrinth-shaped breather chamber 67 which provides communication between the valve-operating chamber 58 and the air cleaner A, and in which gas-liquid separation is conducted to return the separated oil to the valve-operating chamber 58.

The operation of the present invention will be described below.

When the crankshaft 5 drives the camshaft 41 through the timing transmitting device 42, the intake pushrods 44*i*, 44*i* and the exhaust pushrods 44*e*, 44*e* are lifted and lowered through the intake cam followers 43*i*, 43*i* and the exhaust cam followers 43*e*, 43*e* by the rotation of the intake cam 41*i* and the exhaust cam 41*e* of the camshaft 41, thereby swinging the intake rocker arms 45*i*, 45*i* and the exhaust rocker arms 45*e*, 45*e*. The intake valves 25*i*, 25*i* and the exhaust valves 25*e*, 25*e* are then opened and closed by cooperating with the intake valve springs 47*i*, 47*i* and the exhaust valve springs 47*e*, 47*e*. The intake valves 25*i*, 25*i* and the exhaust valves 25*e*, 25*e* of the two-cylinder engine E are arranged in parallel to each other and in the direction of arrangement of the two cylinders 9, 9. Hence, components of the valve-operating mechanism 40, such as the two intake rocker arms 45*i*, 45*i* and the two exhaust rocker arms 45*e*, 45*e*, are correspondingly arranged in the direction of arrangement of the two cylinders 9, 9, which simplifies the valve-operating mechanism 40.

Upon opening of the intake valves 25*i*, 25*i*, air filtered in the air cleaner A is drawn into an intake path of the carburetor 38, mixed with fuel, and then drawn via the intake passages 35, 35 and the intake ports 23*i*, 23*i* into the corresponding cylinders 9, 9.

The intake ports 23*i*, 23*i* adjacent to each other in the two cylinders 9, 9 rise from the corresponding combustion chambers 21, 21, and open at their upstream ends into the intake manifold coupling face 30 opposite the combustion chambers 21, 21. Therefore, each of the intake ports 23*i*, 23*i* is formed to have a relatively smaller curvature, wherein air suction resistance is reduced, and the intake ports 23*i*, 23*i* are relatively more easily molded.

The pair of intake ports 23*i*, 23*i* and the pair of intake passages 35, 35 are independent from each other, respectively, and hence, mutual interference of their air suction abilities does not occur. Thus, it is possible to provide an increase in output from the engine.

The intake ports 23*i*, 23*i* are disposed so that they are nearing each other toward their upstream ends, i.e., the intake manifold coupling face 30, and hence, the pair of intake passages 35, 35 in the intake manifold 36, coupled to the intake manifold coupling face 30, are connected to the intake ports 23*i*, 23*i*, and disposed in proximity to each other, leading to the compactness of the intake manifold 36, and contributing to the compactness of the engine E.

Moreover, the two intake passages 35, 35 are disposed to extend across the outer side of one of the exhaust ports 23*e*, 23*e*, and hence the intake passages 35, 35 are less heated from the side of the exhaust ports 23*e*, 23*e*, thereby enhancing efficiency in filling the intake air into the cylinders 9, 9.

Further, the two intake passages 35, 35 are disposed to extend across one side of one of the spark plugs 27, and hence, the maintenance of the spark plugs 27, 27, including their removal, is easily conducted, leading to an enhancement in maintenance property.

The ventilating gap g is defined between the face 68 of the cylinder head 4 fastened to the cylinder block 3 by the fastening bolts 20 and the bottom wall 58*a* of the valve-operating chamber 58 accommodating the valve-operating mechanism 40. Therefore, by passing cooling air through the ventilating gap g, portions around the bottom wall 58*a* of the valve-operating chamber 58 and portions around the combustion chambers 21, 21 are effectively cooled, and the transfer of heat from the combustion chambers 21, 21 to the valve-operating chamber 58 is suppressed, wherein durability of the valve-operating mechanism 40 is enhanced.

In the fastening of the cylinder head 4 to the cylinder block 3 by the plurality of fastening bolts 20, one or more of the fastening bolts 20 is, or are, disposed in a predetermined position through the operating bore 60 provided in the bottom wall 58*a* of the valve-operating chamber 21, and is then tightened by a tool, such as a wrench, inserted into the operating bore 60. Therefore, despite the presence of the valve-operating chamber 58, the periphery of the cylinder head 4 is firmly fastened to the cylinder block 3 by the fastening bolts 20.

When the head cover 62 is coupled to the cylinder head 4 to close the valve-operating chamber 58 after fastening the cylinder head 4 to the cylinder block 3, the plug 65 integral with the head cover 62 is fitted into the operating bore 60 with the seal member 63 interposed therebetween, wherein the valve-operating chamber 58 and the operating bore 60 are isolated from each other to simply and reliably prevent the oil from flowing out of the valve-operating chamber 58 into the operating bore 60.

Although the embodiment of the present invention has been described in detail, the present invention is not limited to the above-described embodiment, and various modifications in design may be made without departing from the spirit and scope of the invention defined in the claims. For example, the present invention is also applicable to a single-cylinder engine and an in-line four-cylinder engine.

What is claimed is:

1. An engine comprising:

a cylinder head having a valve-operating chamber with an open upper surface;

a cylinder block coupled to the cylinder head by a plurality of fastening bolts;

a head cover coupled to the cylinder head to close the open upper surface of the valve-operating chamber;

a ventilating gap defined between a face of the cylinder head that is fastened by the bolts and a bottom wall of the valve-operating chamber;

an operating bore defined in the bottom wall of the valve-operating chamber to enable insertion of at least one bolt therein and a tool used to tighten each bolt; and a plug integrally provided in the head cover which is liquid-tightly fitted into the operating bore.

2. The engine according to claim 1, wherein the operating bore and the valve-operating chamber are liquid-tightly isolated from each other.

3. The engine according to claim 2, wherein oil is prevented from flowing out of the valve-operating chamber into the operating bore.

4. The engine according to claim 1, wherein cooling air is passed through the ventilating gap to cool a region around the bottom wall of the valve-operating chamber.

* * * * *